US007836522B2

(12) United States Patent
Blecha

(10) Patent No.: US 7,836,522 B2
(45) Date of Patent: Nov. 23, 2010

(54) BANDANA HEADWEAR WITH FLEXIBLE HEADBAND, HAVING OPTIONS OF REVERSIBILITY, ATTACHABLE VISOR, ATTACHED CAP AND 3-WAY VISOR

(76) Inventor: Judy Blecha, 4008 Soapstone La., Gainesville, GA (US) 30506

( * ) Notice: Subject to any disclaimer, the term of this patent is extended or adjusted under 35 U.S.C. 154(b) by 119 days.

(21) Appl. No.: 11/554,373

(22) Filed: Oct. 30, 2006

(65) Prior Publication Data

US 2007/0118971 A1 May 31, 2007

Related U.S. Application Data

(63) Continuation-in-part of application No. 11/029,456, filed on Jan. 6, 2005, now abandoned.

(60) Provisional application No. 60/610,015, filed on Sep. 15, 2004, provisional application No. 60/521,802, filed on Jul. 6, 2004, provisional application No. 60/604,804, filed on Aug. 27, 2004.

(51) Int. Cl.
*A42B 5/00* (2006.01)

(52) U.S. Cl. ..... 2/207; 2/209.12; 2/174

(58) Field of Classification Search ..... 2/171.4, 2/171, 172, 174, 204, 207, 202, 206, DIG. 11, 2/175.1–175.9, 195.1–195.8, 273; 132/59, 132/60, 275, 273
See application file for complete search history.

(56) References Cited

U.S. PATENT DOCUMENTS 2,005,361 A * 6/1935 Rollins et al. ..... 2/195.1
2,824,311 A * 2/1958 Barnett ..... 2/207
2,859,448 A * 11/1958 Gaichel ..... 2/202
3,668,707 A * 6/1972 Williams ..... 2/207
4,462,117 A * 7/1984 Brunelle ..... 2/202
5,381,559 A * 1/1995 Wakefield, III ..... 2/267
5,493,734 A * 2/1996 Nieves-Rivera ..... 2/209.13
5,692,244 A * 12/1997 Johnson et al. ..... 2/181
5,875,493 A * 3/1999 MacDonald et al. ..... 2/172
6,032,292 A * 3/2000 Wood et al. ..... 2/207
6,263,512 B1 * 7/2001 LeDonne ..... 2/171
D542,481 S * 5/2007 Katz ..... D30/145

* cited by examiner

*Primary Examiner*—Gary L Welch
*Assistant Examiner*—Sally C Cline

(57) ABSTRACT

Bandana Headwear, for all ages, is attractive, versatile, easily produced, having numerous uses and advantages. First, the flexible plastic headband, conforming comfortably to head, is removable for washing. Second, there are two ways to wear Bandana. Third, the optional, attached Visor may be worn three ways: extended outward, over top of Bandana, or tucked underneath. Fourth, Bandana and Visor are reversible when either has two fabric layers sewn together. Fifth, incorporating reversible Bandana with 3-way Visor allows twelve different looks. Sixth, larger Bandana with inner cap, completely covering head, was designed for those with total hair loss. This version, combining two end-tying methods and 3-way Visor, provides six different looks. Seventh, an attachable Visor, fastened with VELCRO, enables consumer to buy one Visor, wear with one or more of invention's Bandana styles without Visor or with any headwear with no Visor, unrelated to present invention.

1 Claim, 2 Drawing Sheets

BANDANA HEADWEAR WITH FLEXIBLE HEADBAND, HAVING OPTIONS OF REVERSIBILITY, ATTACHABLE VISOR, ATTACHED CAP AND 3-WAY VISOR

PRIORITY

The present invention claims priority under 35 USC section 119 and based upon the following provisional and non-provisional applications.

3 Provisional Patents by Judy Blecha, relating to this Invention:

Bad Hair Day Cover-up—Jul. 7, 2004—60/521,802

6 Way Visor Head Wrap—Aug. 27, 2004—60/604,804

Headwear with Removable Headband, optional 3-Way Visor—Sep. 15, 2004—60/610,015

Ser. No. 11/029,456 filed Jan. 6, 2005 now abandoned (All incorporated by reference in there entirety) Continuation In Part

BACKGROUND OF THE INVENTION

Initially, I had never seen or heard of any headwear remotely similar to my invention at the time of it's conception, when I first conceived a bandana scarf with a flexible headband secured inside the top portion to keep it on the head. Nor had I seen or heard of it at the time I decided it should be patented, but I learned in April, 2005 there is a prior art (Gaichels, —U.S. Pat. No. 2,859,448) that has just one of the many features of my invention. Claimed as one, the Gaichel Bandana scarf and Visor must be used together in order to accomplish what my Bandana scarf with a flexible headband does without a Visor. This is important because, having marketed it for 5 months prior to first patent application, I learned that more than half of women and girls do not want a Visor. Without the Visor, in which pockets secure a strip of metal or plastic, Gaichel's scarf can only be tied behind the head, thereby not solving the problem of keeping it on the head. Therefore both must be used together. The flexible metal or plastic inserted in the pockets of Visor encircling top, frontal portion of head, extending down to the position of forehead that lines up with the top of eyebrows would need to be fairly tight in order to retain it's position on head, given it's limited length as to not cover the eyes; whereas the headband in my Bandana scarves, do not need to be tight at all, as there is the benefit of being positioned further down, mid point between the top and bottom of ears, enabling headwear to remain on head when outdoors on windy days. As Gaichel uses a triangular scarf or a rectangular one folded over, there is not the possibility of having two separate looks with one scarf as in my method of using two pieces of fabric stitched together; nor does her method of producing have the pointed back portion rounded off, for a hat-like appearance. When positioned in back of the ears, the longer headband in my art, makes the Bandana flare out at the sides, also giving it a hat-like appearance, which is not possible when it is tied behind the head as it is in Gaichel's and other prior art. With all the mechanisms on one side of the Visor, Gaichel's Visor cannot be made reversible, nor does it have options of including weights in lower back seam used to keep scarf from blowing over top of head or the option of utilizing a cap and Visor assembly attached to the Bandana scarf to cover heads of those who have hair loss. Johnson's Cap (U.S. Pat. No. 5,692,244) has a terry cap within an outer cap, having means to adjust for head size and a smaller visor connected to a larger visor; whereas my art is a cap/visor assembly, cut from one pattern, with the cap's stretchable fabric accommodating various head sizes and is comprised of two pieces of fabric that are stitched on the outside to protect a bald head. Brunelle's Drapable head covering (U.S. Pat. No. 4,462,117) is a Bandana scarf that can be tied in various ways, with a large inner cap to protect a hairsetting. It doesn't have a Visor as does my art and is constructed differently, being all one piece, whereas my cap has two pieces of fabric, meant to be covered with Bandana. The two Bandana prior art I found initially are: U.S. Pat. No. 5,542,127 (Bezanis) and U.S. Pat. No. 5,594,956 (Barrientos); however neither of these have features listed above. Other prior art not mentioned here, are listed on PTO Form 892.

ADVANTAGES OF THE INVENTION a. The Bandana Headwear is easily produced and most types of washable fabric may be utilized.

b. While protecting from the sun, at the same time, the fit is loose enough to allow air to circulate around and inside the headwear, particularly when natural fabrics are incorporated.

c. This Headwear may be used for many types of employment for protection and sanitary purposes.

d. When knits or other warm fabrics are used to make the Headwear, it is very suitable for cold weather wear. The knots cover ears, keeping them as warm as the rest of head.

e. The Headwear can be waterproofed, however without doing so, it protects hair in light rain.

f. Bandana portion can be made almost wind-proof by simply adding two small weights in seam, near "v" in back or centered in back seam when Bandana is rounded as in reversible style.

g. Ideal for bad hair days, headwear folds easily and can be carried in a handbag, large pocket or packed in luggage without wrinkling.

h. Depending on the style and fabric chosen, Headwear can be worn for sports events, in the workplace, convertible vehicles, on the golf course, for water aerobics as well as occasions where a casual, yet stylish look is desired.

i. With each Bandana style, there are two different ways for it be worn as pertains to placement on head.

j. Attaching the 3-Way Visor on a single-sided Bandana gives the wearer at least 6 different looks.

k. When the 3-Way Visor is sewn into a reversible Bandana style, at least 12 completely different looks are possible.

l. One attachable 3-Way visor can be purchased in a neutral color and used with numerous Bandanas without a Visor or with other types of headwear with no Visor, unrelated to present invention.

m. Persons without hair can now have a total covering for their head that is as attractive as it is protective and has added features of at least 2 to 6 different looks with one purchase, depending on whether or not the 3-way Visor is used.

n. Utilizing accessories to dress up Headwear is creative and fun for women and children.

SUMMARY OF THE INVENTION

Whereas it was the flexible, plastic headband that first came to mind when this idea was in it's earliest stages, which solves the problem of Bandana slipping off head, when inserted into Bandana scarf top pocket or seam, and different ways of positioning it enable two separate looks for wearer, perhaps it is when it is used with the 3-Way Visor, or when included with the Reversible style headwear, making it possible to have at least twelve different looks, is what sets this invention apart from prior art of not only Bandana style headwear, but of all headwear styles in general. It further differs from other bandana styles in that, having several inches cut before stitching, thus not long enough for tying behind head, unless the larger style is made, the ends of Bandana are tied in knots or secured by various type fasteners, at the sides of the head, near the ears. There is no need to tie behind head or under chin as Bandana stays securely on head because of the headband, and look more like a trendy hat than a traditional scarf. However, in the case of those who require the larger style to completely cover their head, there remains an option of tying ends to each other behind back of head at top of neck. The non-binding, flexible headband, extending mid-point, in front of or behind the ears enables the Bandana headwear to stay in place and has the added attraction of allowing two different looks depending on placement on the head.

Some styles of present invention may be more suitable for women and female children; however this headwear may be worn by men and boys, particularly the larger style that is tied behind the head, at top of the neck, when a total head covering is desired to conceal hair loss and/or protect from the elements as when riding a motorcycle or working outdoors. Made out of any type or color of fabric, preferably washable, the headwear may have a logo or insignia included on the side or back and is useful for various types of employment where hair needs to be covered for health and/or safety reasons.

Although the invention has been described with references of the embodiments which are illustrated in the drawings, one or more substitutions, additions and/or deletions may be made without departing from the scope of the invention as noted in the claims.

Examples—scalloped edging, and in partial view, zig zags

Figure 2:
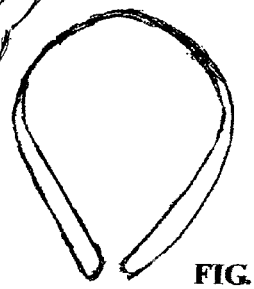

FIG. 2 shows the headband that is easily inserted into or removed from the tubular pocket of all Bandana style when the proper size seam is sewn. Usually 14½" long, it can be any width, from approximately ⅓ inch to 1 inch or more.

Figure 3:
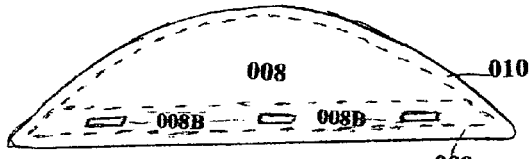

FIG. 3 shows the Visor that is detachable for all Bandana styles, includes the 3 small rectangles that fasten it to the Bandana scarf. The fasteners are eliminated when it is desired that the Visor is sewn into the seam of the reversible style or on the reverse side of the single Bandana style.

The dashed lines show where the two pieces of fabric that are needed for said Visor will be attached; for example by being stitched.

Figure 4:
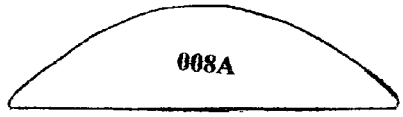

FIG. 4 is the flexible interfacing (stiffening fabric) insert that is sandwiched between the two layers of fabric that form the Visor.

Figure 5:
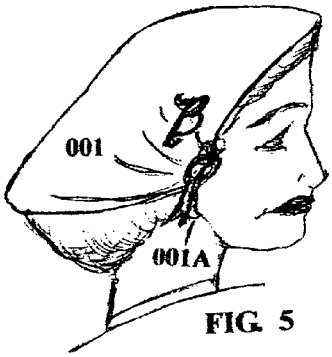

FIG. 5 is the basic Bandana style, with headband positioned in front of ears, knots tied at ends, showing a logo insignia on the side.

Figure 6:
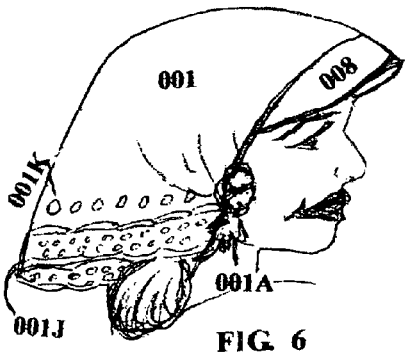

FIG. 6 shows a Bandana with optional 3-way Visor, worn extended outward. It further shows optional decorations: beads 001*k* and lace 001J.

Figure 7:
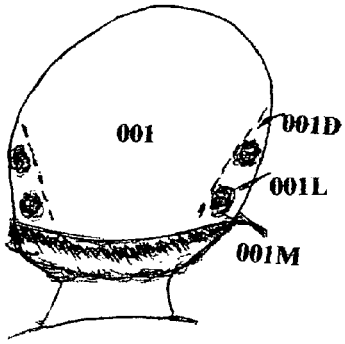

FIG. 7 depicts the rounded back side of a reversible Bandana with fringe trim and the dotted lines identify that remaining fabric unrestrained from ends of headband are folded underneath Bandana instead of being tied into knots. Fastening mechanisms thereon are hidden with flaps that have embroidered flowers.

Figure 7A:
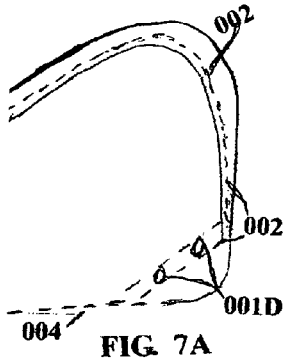

FIG. 7A shows one side of the inside of Bandana scarf when the alternative method of securing the unrestrained ends is desired. Said end is folded at the position where headband ends, over to the backside, lining up horizontally with the side seam of scarf.

Figure 9:
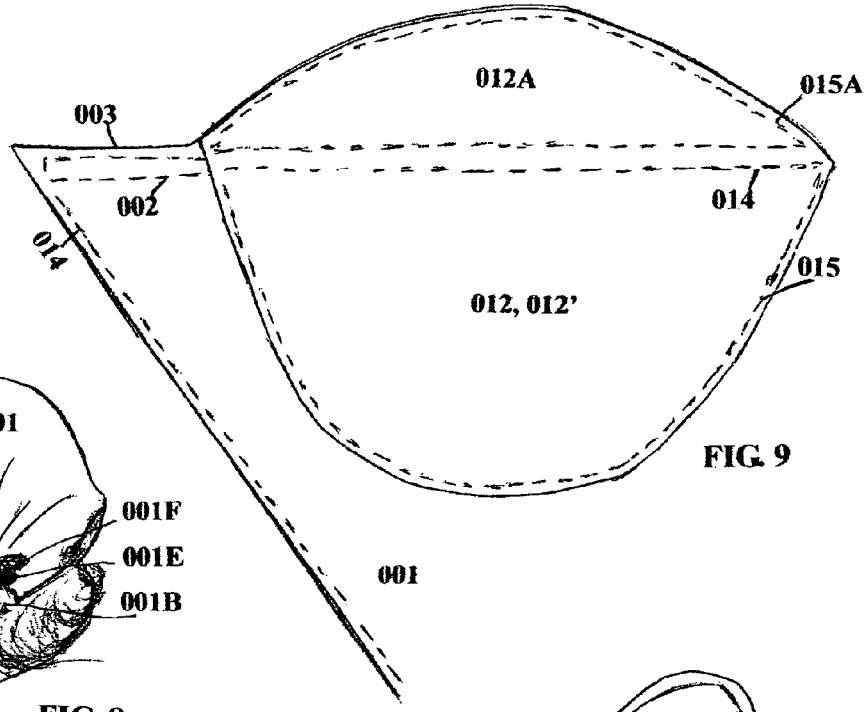
Figure 8:
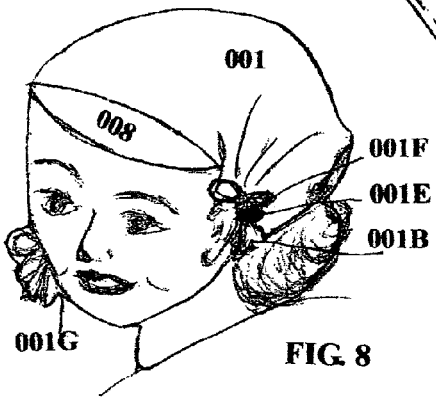

FIG. 8 shows a smaller Bandana on a young girl, sides flared outward as headband slants rearward, center of headband at top of forehead with ends positioned behind the ears. The small size determines that a ribbon, elastic or barrette be used, there is not enough slack material remaining for knot tying when headband is inserted. These options are shown respectively as 001G, 001E and 001F FIG. 9 depicts the cap/Visor assembly, made from two near identical pieces of knit or other stretchable fabric 012, 012' and 102A, which make up the cap and Visor that once assembled is attached and may be sewn inside the larger version of the bandana style for those who have lost hair or wish to cover entire head for other reasons. A second cut on one piece of fabric only is necessary in order to have an opening for head. It shows a partial view of Bandana and other dashed lines are explained fully in details of second embodiment.

Figure 10:
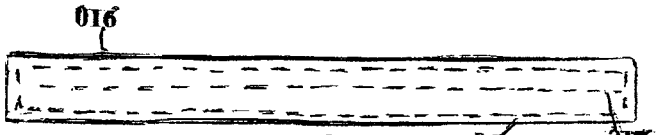
Figure 11:
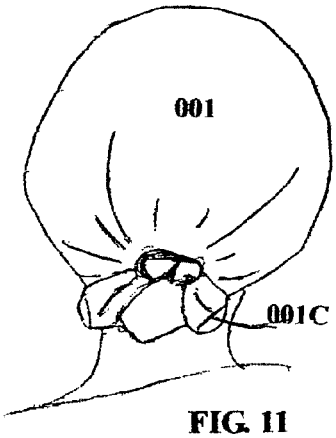

FIG. 10 illustrates a strip of knit or elastic fabric that is folded, becoming the binding for the back portion of the cap (front part is stitched to top of bandana). The dashed lines show where it is turned under and attached and may be stitched to said portion of cap FIG. 11 is a back view of larger Bandana style for hair loss or for those who need protection from the elements; it's larger size enabling that it can be tied behind the head and is suitable for men as well as women and children.

Figure 12:
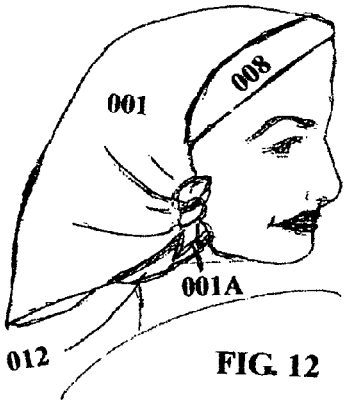

FIG. 12 shows the larger Bandana style with double knots tied in front of ears and Visor folded-back over the top of the Bandana. The cap portion 012 is partially hidden and may be just barely visible.

Figure 13:
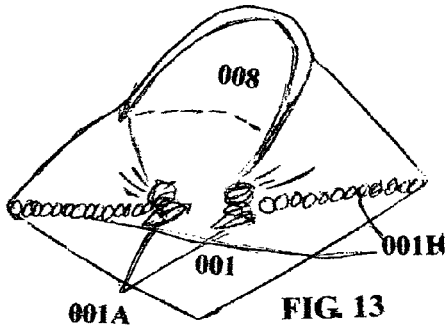

FIG. 13 shows a reversible Bandana folded flat for storage or traveling. The dashed lines show where a Visor, when applicable, would be folded compactly inside. Sequins 001H are shown as yet another decorative option.

Note: FIGS. 6, & 12 show ways to wear the versatile Visor, with FIG. 6 depicting Visor being worn in the traditional manner and FIG. 12 showing Visor being worn folded up over top of Bandana, like a cuff. Another option is for it to be tucked under the bandana, thus invisible, when no visor is desired.

FIGS. 8 & 12 additionally show that when the two ways of positioning Bandana scarf on head times 3 ways of wearing Visor, times two different sides (reversible style), there is a possibility of at least twelve different looks. FIGS. 5 & 12 further show versions with knots tied at each end. However ends can be secured to the side of Bandana with hooks and loop fasteners, (VELCRO) or buttons as in FIG. 7 or other means now known or yet to be invented.

DETAILED DESCRIPTION OF THE FIRST EMBODIMENT

Figure 1:
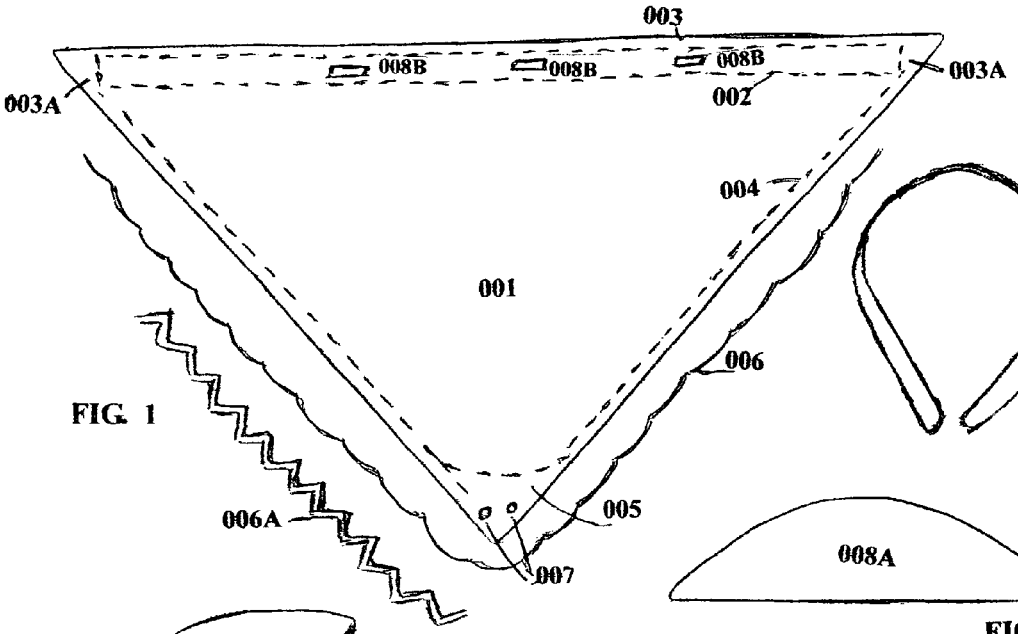
FIG. 1 is an illustration of the basic Bandana pattern, dashed lines adjacent to the solid lines showing where there is stitching, or where the ends are cut, positioning of optional weights, when desired, dashed line at back of Bandana (005) shows where to cut when producing the reversible style; and placement of the rectangular strips when the optional, attachable Visor is desired. In addition it also shows optional edges that could be utilized.

Referring first to the Single-sided Bandana 001 of FIG. 1, it is made from a substantially triangular piece of any suitable type of washable fabric, the long end of said triangle is turned under approximately ¼", 003 secured down by ironing, then turned under again 002 to the back side of fabric, after which approximately 1½" to 2" of both ends 003A have been cut with pinking shears and turned under approximately ¼". This seam 002, when stitched, forms a tubular pocket, through which the headband will later be inserted. Using several pins to keep the seam intact, the shorter sides of triangle 004 are folded doubly, usually approximately ¼" or smaller, normally done simultaneously as the seamstress sews. When it is desired that small weights 007 which may be lead be used to keep the back of bandana from being blown over top of head in windy situations, the weights are inserted and attached with washable glue or other suitable material inside the seam near the point at back of bandana before stitching. The seam would need to be slightly larger to accommodate the weights.

All seams are then attached and may be sewn, leaving the approximate 1" ends 003A open for headband FIG. 2 to be threaded through. The three small approximate rectangles 008B will be explained later. When logo or other insignia and/or trim such as fringe, lace, etc is desired as in FIG. 7, it is attached and may be sewn on at this time.

The optional, attachable and detachable Visor, shown in FIG. 3, works well with the single-sided Bandana 001 style as the rectangular strips 008B (usually VELCRO) are not seen when secured to the back side of Bandana, placed near the seam 002 for headband.

When it is desired that Visor of FIG. 3 be an attached (or sewn in) one, it is centered and sewn on the reverse side, on same seam 002 as for headband. More details of Visor to follow.

The Headband shown in FIG. 2, which holds Bandana on the head, presently used is "U" shaped, approximately 14½ inches long and of various widths. Molded of flexible plastic, the headbands are quite comfortable to wear as they bend easily to conform to head and other suitable materials could be used. One size fits all comfortably, but a shorter one for babies and toddlers would be preferable as there is not enough room left over at the top seam of triangle in order to tie a knot when the approximate 14½" headband is used. Hair clips, pony tail holders, or barrettes can be used to secure the headband; however a shorter headband would allow a knot to be tied. It would be helpful for consumers to note on the purchase label that the headband is to be removed for machine washing, adding the headband could be left in place when washing by hand. A note on the reversible style could further state that it is not necessary to remove headband to wear on the reverse side. Instead one holds onto bandana with forefinger and thumb of both hands positioned at top center of headband and flips the fabric over top the headband approximately 180 degrees.

Once headband shown in FIG. 2 is centered inside seam, the length of fabric extending from both ends being near identical, said ends can be tied into knots, 001A the preferred method. Another method is that ends may be folded over, front to back, starting at point where headband ends, proceeding to bottom of bandana fabric and securing at position where it matches up horizontally underneath bandana with seam 004. One preferred method of securing said alternate method is snaps or hook and loop fasteners (VELCRO) FIG. 7, 001D.

This alternative method only works with the adult size as there is not enough fabric for folds in the smaller Bandana styles for children. Decorative items such as buttons, small flowers, sequins, etc. could be placed on this part 001D for women's styles.

When knots are desired and longer tails are desired, one would not snip the ends off, as shown in FIG. 1, 003A, before sewing as previously described. For a double-sided bandana, also known as the Reversible style, the description of FIG. 1 will suffice, but method of sewing is slightly different, being that there are two pieces of fabric, each cut the same size. This style is usually made from two different colors and/or types of pre-washed fabric to ensure there is no bleeding of colors and/or shrinking, They are placed one on top of the other, right sides facing together. Several pins hold the fabric in place while, when first ironing, before sewing, the elongated side of each piece of fabric is turned under approximately ¼" as shown in FIG. 1, 003, from right side to back side of fabric. Approximately one and ½" to 2" are cut off both ends 003A with pinking shears and turned under ¼". The two shorter sides 004 of triangle are stitched together on the reverse side, leaving one inch at top unstitched as this is where headband of FIG. 2 will later be inserted in the tubular pocket when stitched. 002.

When desired, this reversible style can easily have scalloped 006 or zig zag edging 006A.

Then this stitched portion is turned right side out and pressed. The turned-under, horizontal part that was ironed earlier 003 is then matched up evenly, secured with several pins and sewn close to the edge, carefully, so that the color on the reverse side is not visible. The seam should be approximately ¼" from edge or less. A second horizontal seam, 002 is then sewn one inch away from first seam 003. With this second seam sewn, there is now an opening 003A, FIG. 1, through which the headband of FIG. 2 can then be approximately centered inside the seam. After the headband of FIG. 2 is centered inside seam, the length of fabric extending from both ends of headband being approximately the same, said ends can either be tied into knots, the preferred method, or the ends can be turned under, front to back as in FIG. 7, 001D as described for the single-sided Bandana style. A decorative article, such as an embroidered flower or design, attached in part as a flap, could hide the fastening device 001D horizontally underneath bandana with seam 004 FIG. 7A. Preferred method of securing said alternate method is snaps or hook and loop fasteners (VELCRO) FIG. 7A, 001D.

This alternative method only works with the adult size as there is not enough fabric for folds in the smaller Bandana styles for children. Decorative items such as buttons, small flowers, sequins, etc. could be placed on this part 001D for women's styles. The appearance of the outside of said alternative style is shown in FIG. 7, with the dashed lines showing where the folds end on the reverse side of bandana scarf.

If the fabric is thick, such as knit, velour, or others suitable for cooler weather, and can not easily be knotted, ends may be closed by using various other devices, such as elastic pony-tail holders, ribbons, hair clips, barrettes or whatever closure is desired. The latter is suitable for children's Bandana headwear.

When longer tails, hanging down from knots are desired, one would not snip off ends 003A before sewing as previously described.

Due to the fact that less fabric is turned under on the reversible headwear, it is longer in the back than single-sided version. The headwear looks most attractive when the back length of crown portion ends midway down at back of head. For this reason it is desirable to slightly round off the back portion of reversible Bandana headwear as shown in FIG. 1, 005, making the total length of Bandana about 2" less than the singled-side version. FIG. 7. Should a longer appearance (for the back part of the Bandana headwear) be desired, the "V", pointed shape remains.

When optional, attached Visor shown in FIG. 3, is to be used, it is centered, pinned between the two pieces of fabric and sewn to Bandana before two seams 002-003 of FIG. 1, which form the opening of the headband, are sewn. The separate, attachable and detachable Visor can not be positioned on the reversible headwear because the attachment device to attach it would be visible on one of the sides.

Both the single-sided and reversible styles of Bandana headwear can be dressed up in a variety of ways. Flowers, iron-on embroidered items, buttons, ribbons and beads for example, can be added. If sold plain, though, user could choose their own trim or leave unadorned.

Both styles can also be folded flat when not being worn as shown in FIG. 13, with knotted ends 001A also lying flat. The flexible Visor, when applicable, can be tucked inside 008. The headwear may easily be packed for traveling. When folded, it is compact enough to fit in a large pocket or handbag. The Visor as shown in FIG. 3, 008 can be made from any fabric, usually same as Bandana part of the headwear, when it is be attached. For reversible Bandana headwear, the visor color should blend and not clash with reverse side when one color Visor is used. However, the Visor, since it is made from two pieces of cloth, can also be made with the same two colors or types of fabric as the Bandana headwear. This would be the preferred method. Rounded, like half an oval shape, with one straight edge, in various sizes proportioned to Bandana size, the Visor is made by placing two pieces of fabric, right sides together, then stitch an approximate ¼" seam around curved portion of Visor, 010 leaving the straight edge 009 open. Turn right-side out, and iron. Place the flexible, stiffening fabric insert of FIG. 4 inside and after turning the straight edge 009 of both sides under an approximate ¼", it is then ready to be centered on inside of completed single-sided Bandana headwear or between both top edges of reversible style and stitched on both seams of Visor 009 and 011, together with seams 002 and 003 of the Bandana. Instead of sewing seam 009 of straight edge of Visor, one could cut it with pinking shears, but the sewn seam is preferable. The width of fabric for Visor exceeds that of the stiffening fabric insert by an additional inch, not counting the approximate ¼" mentioned above, in order to be sewn without unnecessary bulk on lines of stitching that secures opening through which headband is inserted. As concerns the reversible style, it should be noted that even with extra fabric for Visor inside opening for headband, there is still ample room for said headband to be inserted.

The Visor Insert of FIG. 4, 008A can be made from any suitable, flexible interfacing that is washable, doesn't ravel and is stiff enough to retain it's shape. Two brands I've used are PELLUM and HRT, both extra firm. The insert is rounded, same shape as Visor, and is about ¼" smaller on all sides in order to fit inside after seam is sewn on Visor.

For both single-sided and/or reversible styles, when there is not enough fabric on the finished Bandana 001 for knots 001A to be tied as shown in FIG. 8 for toddler's smaller size bandana, another method is that open ends can be closed by using various means, such as elastic pony-tail holders, ribbons, hair clips, barrettes or whatever closure is desired 001A.

The method of wearing both the single-sided and reversible styles is shown in FIGS. 5, 6, 7, and 8. FIG. 5 shows the headwear being worn without a Visor. FIGS. 5, 6, & 7 and 12 shows how headwear looks when worn with headband in a straight, vertical position, with ends in front of ears, appropriate and preferable for cooler weather. FIG. 8 shows how the look is different when, holding onto headband with both hands, the bandana is tilted to the back of head, stopping with ends directly behind ears, causing Bandana portion of headwear to flare outwardly at sides, giving a more casual, sporty look.

The ways of wearing Visor are shown in FIGS. 6, 8 & 12. FIG. 6 shows Visor 008 extended outward, and FIG. 12 shows Visor 008 folded over top of Bandana as a cuff, and being flexible, it can also be folded underneath the Bandana, not showing at all, if desired. The drawings clearly reveal the possibility of at least 12 different looks when one multiplies the 2 ways of wearing the bandana times 3 ways of wearing Visor times 2 fabric sides when reversible style is purchased. Six looks are possible with single-sided Bandana style with the attached Visor.

It is not necessary to remove headband when choosing to wear bandana headwear on the reverse side. With forefinger and thumb of both hands placed closely together at top of Bandana, pressing lightly against headband, one merely flips the fabric 180 degrees to reverse side.

DETAILED DESCRIPTION OF THE SECOND EMBODIMENT

This larger Bandana Headwear style, incorporating an internal, attached cap and optional Visor or Visor/cap assembly, is used when total head coverage is desired such as when there is hair loss or head needs to be protected from the elements.

The method of making the Bandana scarf for this style is basically the same as that of the first embodiment and references will be made to FIG. 1, as applicable. The bandana portion 001 of FIG. 1 is made from a substantially triangular piece of any suitable washable fabric, which when sewn or attached in some fashion is attached to cap or cap/Visor assembly.

To make the cap with Visor (called cap/Visor assembly), with pinking shears, cut a double thickness of knit or any stretchable fabric, approximately 12" wide by approximately 12½" at the longest part, where Visor meets top of cap. FIG. 9, 012, 012' 012A. On one piece of the fabric only, cut a diagonal line where the visor ends and the cap starts as shown in FIG. 9, 014, approximately five inches from the widest part of Visor. Cap portion is approximately 7½". Next, the strip that serves as a binding for one half of opening for knit cap, FIG. 10, is turned under approximately ¼' to reverse side on each of adjacent sides 016 and pressed with iron; then fold evenly 017 over straight end of cut side of cap, 014, which is then pinned and stitched. Cap/Visor assembly is then tacked with pins, and sewn on the reverse side, with approximate ¼' seams all the way around perimeter 015 and 015A. The head of wearer fits through opening. The stitched side (015) of cap portion is on outside to ensure comfort of a bald head, if applicable. It should be noted here, that in lieu of using pinking shears to cut fabric before stitching, another method is to use serging as a means to keep the fabric from unraveling as well as to use less fabric.

For Visor insert as shown in FIG. 4, 008A, cut a piece of washable, flexible, non-raveling interfacing, such as PELLUM or HTC, extra firm, slightly smaller than Visor 012A and insert inside top portion of cap/Visor assembly of FIG. 9 after turning it right side out. The bottom or cap portion is not turned right side out for reason stated above. Both pieces of fabric 012A that form double thickness of Visor are then turned under approximately ¼" to under side.

The cap/Visor assembly is centered, pinned and stitched to same line of stitching on the underside of Bandana 002 which forms the tubular pocket where headband will be inserted 003A.

The headband can then be centered inside seam and after making sure the length of fabric that extends from ends of headband are identical, the double knots as shown in FIG. 12, 001, can be tied. With this larger Bandana style version, ends may also be tied at back of wearer's head as in FIG. 11. This will be detailed later.

The method of preparation when it is desired that Visor be of same fabric as Bandana scarf is as follows: Two separate pieces of fabric for cap are cut and pinned, wrong side facing out. Referring now to cap portion 012, FIG. 9, stitch an approximately ¼" seam around all edges, except top. A strip of knit fabric, cut approximately 1½"×25", which will be the binding for seam on ½ of cap's perimeter, or the opening for head, is then turned under approximately ¼" on each adjacent side 016 and folded evenly 017 over straight end of cap 014; then is pinned and stitched. Only one side of this straight end 014 will be sewn to Bandana scarf as there needs to be an opening for cap to be placed on wearer's head.

Cut Visor 008, FIG. 3 from same fabric as Bandana scarf, sized in proportion to said Bandana scarf, stitch along the rounded side 015A and turn right side out. Press and insert interfacing (stiffening fabric) 008A.

Turn straight edge, FIG. 3, under approximately ¼", press and sew seam 009 to secure insert. Next, pin the straight end of Visor to straight end of one side of cap, approximately ¼" from fabric edge of each. Center and sew, pinning first if desired, to inside of bandana scarf, approximately 1" from top on same seam 002 as the one through which headband will be inserted. The width of fabric for Visor exceeds that of Visor insert by an additional inch, in order to be sewn without additional bulk of insert when stitched to Bandana. It is preferable that a Visor be used with this style when it is to be used for those persons with hair loss. It may be eliminated for men and boys' usage however.

The Visor insert can be made from any suitable, flexible interfacing that is washable and stiff enough retain it's shape when bent. Two brands I've used are PELLUM and HRT, both extra firm. The insert is curved, same shape as Visor, and is slightly smaller on all sides in order to fit inside Visor after seam is sewn.

The headband of FIG. 2 that holds Bandana in place is not seen when it is threaded through opening at top of Bandana, is an upside down "U" shaped, flexible plastic and one size fits all.

It is the last part to be assembled to complete this style. The bandana headwear is now ready to wear and wearer may choose to tie extra long ends of scarf in two knots 001A at each end, near ears, or pull them behind head and tie at top of neck.

FIG. 12, shows the longer style of the bandana headwear, with a Visor included, being worn with double knots 001A tied near the ears. The cap 012 is slightly visible at top of neck, right below the end of Bandana scarf. The Visor 008 shown here is folded back over the top of Bandana scarf, like a cuff.

FIG. 11 shows the longer Bandana headwear 001 being tied behind the head, which is the alternative way to tie two ends. When no Visor is included in this style, there are two different looks possible because of the two ways to tie the ends.

DETAILED DESCRIPTION OF THE THIRD EMBODIMENT

The attachable Visor of FIG. 3 is the third embodiment of this invention. Designed to be used with Bandana headwear without a Visor, it can also be used with any type headwear without a Visor, unrelated to present invention. The Visors may be of various sizes, depending on size of Bandana scarf, and whether used for children or adults.

The attachable Visor of FIG. 3 can be made from any washable fabric and is usually made in neutral colors such as white, black, beige, etc. that would blend well with Bandana headwear to which it would be attached. When an attachable Visor is to be packaged with a Bandana headwear product, it could be the same color and/or fabric as said Bandana headwear, however. Curved, like half an oval shape, with one straight edge, the Visor 008 is made by placing two pieces of fabric, right sides together, then stitch an approximate ¼" seam around curved portion of Visor, 010 leaving the straight edge 009 open. Turn it right-side out, and press. Place the stiffening fabric (insert) 008A, FIG. 4 inside and after turning straight edge 009 of both sides under approximately ¼", the seams 009 and 011 are ready to be sewn together.

The Visor Insert of FIG. 3 can be made from any suitable, flexible interfacing that is washable, non-raveling and stiff enough to retain it's shape when bent. Two brands I've used are PELLUM and HRT, extra firm. The insert is curved with a straight edge, same shape as Visor, and is slightly smaller on all sides in order to fit inside Visor.

To complete attachable with insert assembly, the desired fastener is then added. Three or more hook and loop fasteners (VELCRO) strips, preferred choice, or snaps 008B may be placed near straight edge of Visor as shown in FIG. 3.

The VELCRO would be pre-attached to Visor and a small amount of washable glue should be packaged with it, in order that consumer could easily attach other side of VELCRO to their headwear without a Visor. To use attachable Visor, it would be centered on reverse side of single-sided Bandana at top, with VELCRO strips 008B being placed near the approximate 1" seam for headband as shown in FIG. 1, 008B and glued. Washable glue must be used and instructions for consumers would need to be printed on label.

This attachable Visor could be packaged with Bandana headwear styles without an attached Visor. It could also be packaged separately and offered at a special price when consumers purchased more than one Bandana style without a Visor. While the present invention has been described in terms of fabric, a sheet of fabric is within the scope of the invention. Additionally, while the present invention is described in terms of sewing the fabric together, other devices of attaching the fabric such as gluing is within the scope of the invention.

SUMMARY OF THE EMBODIMENTS

A substantially triangular-shaped Bandana scarf is made from a suitable fabric, preferably washable, with flexible, U-shaped, plastic headband and is the basis for which Bandana scarf stays securely on head. The headband is inserted in a horizontal tubular pocket sewn on the longest side, or top, of Bandana. The ends of which tubular pocket are left open for easy insertion and removal of said headband which is centered and secured inside pocket or seam by several methods. The preferred method is that both remaining ends of fabric, unrestrained by headband are tied into knots with an option of placement on head of said headband, behind ears or in front, which allows two different looks for the Bandana and optionally small lead weights may be sewn inside the back seam to lessen the chance of the lower portion of Bandana being blown up over top of head in excessive wind.

An additional piece of the same or a different fabric can be stitched together, and this allows for ease in reversibility as fabric can be changed quickly to reverse sides when wearer uses fore finger and thumb to twist the fabric over headband 180 degrees. Extra width within an elongated seam allows for movement of the headband. The preferred method of producing is rounding off the pointed back portion which gives for a hat-like appearance.

The article of headwear that uses an alternate method of securing the remaining ends of fabric of top seam, unrestrained by headband, which is that they be tied with ribbons, elastic or barrettes. Bandana styles for children and/or babies would need to have this method utilized, since there is not enough fabric available to tie knots after the headband is inserted in top seam of smaller Bandana scarves.

The article of headwear that uses an alternate method of securing remaining ends of fabric of top seam, unrestrained by headband, by folding it under Bandana scarf in area behind ears, securing it with hook and loop fasteners, (VELCRO) or snaps. Ornamentation such as embroidery or buttons may be used to cover securing mechanisms if visible on the side facing out.

The article of headwear may have other than a straight edge on sides of Bandana, namely scallops or zig zags.

The article of headwear of which trim is added to either or both sides of Bandana, except for slack leftover on each side of top seam which secures headband in place, said trim being fringe, synthetic hair, ribbons, lace, beads, sequins or any other desired trim.

An optional, attachable Visor, made with two pieces of the same or different fabric with a straight and a curved, arc-shaped edge, sewn together after PELLUM or any suitable stiffening material has been inserted between the two which can used with article of headwear described above or with other headwear without a Visor;

It can be worn extended outward or folded up over top of bandana, and the Visor is attached by hook and loop fasteners, (VELCRO), snaps or buttons. An option being that the fastening mechanisms are not used and Visor is sewn under top seam of Bandana or inside top seam when reversible style is produced, enabling it to be tucked under top portion of Bandana and not seen in addition to being worn extended outward or folded up over top of Bandana, allowing Bandana to achieve at least 3 different looks.

The article of headwear as described above except that it is cut in a larger size to cover heads of persons who have hair loss or need extra protection from elements, and having added benefit of extra length, making it possible to either have two knots at each end of top portion of Bandana or having ends tied behind head;

More options are utilizing different edges as described or including trim.

Cap/Visor assembly with insert consisting of two oval-shaped pieces of knit or other stretchable fabric, cut slightly wider at top ⅓ portion, stitched together to form both a cap and flexible Visor assembly to be attached to article of headwear with one piece of said fabric cut into two pieces, allowing an opening for head; Stitching and securing together the two pieces of fabric that make up cap portion, and on the outside for head comfort when wearer is bald.

Flexible Visor portion of assembly has insert made of PELLUM or similar stiffening material added prior to being stitched to Bandana scarf on same line of stitching that is shared by one half of the opening of the inner cap.

The article of headwear that utilizes an attached cap and Visor assembly except that the half circle-shaped cap is a separate entity from flexible Visor. When it is desired that said Visor be made from same fabric as that of Bandana or a different fabric from that of cap and may either be stitched under Bandana top seam, sharing same line of stitching as one half of attached cap or may be an attachable one.

What I claim is:

1. A headband and scarf combination comprising:

a substantially triangular piece of cloth having a long side and two sides converging to a point;

said long side having a hem formed by folding over a portion of a peripheral edge of said long side and securing said hem with stitching at spaced locations along the length of said long side thereby forming a tubular pocket with open ends for receiving a headband;

a flexible U-shaped headband positioned centrally within said tubular pocket;

each open end being knotted so as to contain said flexible U-shaped headband within said pocket and for allowing removal of said U-shaped headband for cleaning;

a visor fabricated from an upper and lower sheet of cloth, each sheet of cloth having a straight edge and a rounded edge thereby forming a pocket for receipt of a stiffening fabric therebetween, said upper and lower sheet of cloth secured together at said straight edges and said rounded edges with stitching to retain said stiffening fabric within said pocket;

said visor secured centrally to said long side of said triangular piece of cloth; and an internal cap fabricated from a front panel and a rear panel of cloth material, each panel having a bottom edge, top edge and side edges wherein said top edge and side edges of said front panel are stitched to said top edge and side edges of said rear panel to form a head receiving opening for receiving a user's head, wherein the bottom edge of said front panel is stitched to said visor and the bottom edge of said rear panel is not attached to the visor.

* * * * *